United States Patent [19]

Penninger et al.

[11] Patent Number: 4,902,443

[45] Date of Patent: Feb. 20, 1990

[54] DICARBOXYLIC ACID MONO-(2-HYDROXYDODECYL)-ESTERS, THEIR SALTS AND THEIR USE AS CORROSION INHIBITORS IN AQUEOUS SYSTEMS

[75] Inventors: Josef Penninger, Hilden; Volker Wehle, Haan, both of Fed. Rep. of Germany

[73] Assignee: Henkel Kommanditgesellschaft auf Aktien, Duesseldorf, Fed. Rep. of Germany

[21] Appl. No.: 61,856

[22] Filed: Jun. 12, 1987

[30] Foreign Application Priority Data

Jun. 12, 1986 [DE] Fed. Rep. of Germany ..... 3619804

[51] Int. Cl.[4] ..... C09K 3/00; C07C 69/80; C07C 69/40; C07C 69/42; C07C 69/593

[52] U.S. Cl. ..... 252/388; 252/389.1; 252/389.23; 252/389.24; 560/89; 560/198

[58] Field of Search ..... 252/388, 389.1, 389.23, 252/389.24; 560/89, 198

[56] References Cited

U.S. PATENT DOCUMENTS 4,219,665 8/1980 Zeidler et al. ..... 560/122
4,236,022 11/1980 Zeidler et al. ..... 560/198
4,515,974 5/1985 Zecher et al. ..... 560/198 X

FOREIGN PATENT DOCUMENTS 3300874 7/1984 Fed. Rep. of Germany .
2364883 4/1978 France .
2011403 7/1979 United Kingdom .

*Primary Examiner*—Werren B. Lone
*Assistant Examiner*—Vera C. Clarke
*Attorney, Agent, or Firm*—Ernest G. Szoke; Wayne C. Jaeschke; Real J. Grandmaison

[57] ABSTRACT

Dicarboxylic acid mono-(2-hydroxydodecyl)-esters corresponding to the following general formula

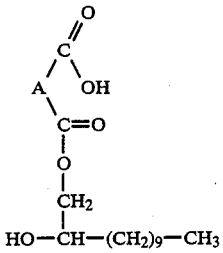

(I)

and salts thereof corresponding to the following general formula

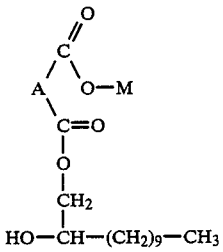

(II)

wherein A represents the radicals

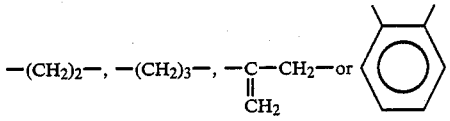

and M represents an alkali metal or ammonium, the use of these compounds as corrosion inhibitors in aqueous systems either by themselves or in combination with one or more complexing agents in concentrations of from 1 to 100 ppm, optionally in the presence of other scale inhibitors, dispersants, non-ferrous metal inhibitors, and/or microbicides.

27 Claims, No Drawings

DICARBOXYLIC ACID MONO-(2-HYDROXYDODECYL)-ESTERS, THEIR SALTS AND THEIR USE AS CORROSION INHIBITORS IN AQUEOUS SYSTEMS

BACKGROUND OF THE INVENTION

1. Field of the Invention

This invention relates to dicarboxylic acid mono-(2-hydroxydodecyl)-esters, to salts thereof and the use thereof as corrosion inhibitors in aqueous systems.

2. Discussion of Related Art

Water-carrying plants, such as a steam-generating plant, heating systems, cooling water circuits and closed waterline systems are always exposed to the corrosive effect of the water circulating in them which is directed primarily against the base metals of the particular systems, for example steel, brass, aluminum, zinc or galvanized steel. The risk of corrosion is further increased by the fact that high temperatures generally prevail in such plants and the circulating water contains constituents which also chemically promote the corrosive attack on the particular materials. Accordingly, chemicals which are intended to guard against or completely prevent corrosion have long been added as corrosion inhibitors to the water circulating in the afore-mentioned systems. In this connection, particularly good results have been obtained with phosphorus-containing compounds, for example phosphonic acids or inorganic phosphates, which are optionally combined with zinc salts. Hitherto, the effectiveness of combinations such as these has been entirely satisfactory.

However, the recently discovered relationship between a high phosphate content of natural waters and eutrophication, which has even resulted in legal stipulations relating to the constituents of raw water systems of water-carrying plants, has led to the requirement that such raw waters be substantially or completely free from phosphorus-containing compounds. In addition, the phosphonic acids or inorganic phosphates mentioned, as corrosion-inhibiting additives to raw water, have the further disadvantage from a practical and technical point of view that they also promote increased biological growth within the cooling systems so that microbicides must also be added to the systems to inhibit such growth.

Since relatively hard waters are also occasionally used in raw-water circulation systems of the type herein, the use of phosphate-containing corrosion inhibitors additionally leads to the formation of apatite or apatite-like deposits which, like the known boiler scale, considerably complicate the transfer of heat and hence lead very quickly to operational disturbances. In addition, such deposits are extremely difficult to remove, particularly in closed circuit systems.

Problems also arise where zinc salts are used in combination with phosphorus-containing corrosion inhibitors of the type under consideration. Zinc salts are generally known to be very toxic to fish so that the waters of the type herein must not under any circumstances enter the effluent. In addition, the self-purifying power of natural waters is distinctly inhibited at zinc concentrations of only 0.1 ppm and higher. Further, the use of combinations of zinc salts with phosphonic acids or phosphates generally leads at relatively high pH values ($pH > 8.0$) to increased siltation of the raw-water circulation system through the precipitation of zinc hydroxide.

The corrosion-inhibiting effect of dicarboxylic acid semi-amides and derivatives thereof, particularly succinic acid semi-amides, is known from German Patent Application No. 33 00 874. Unfortunately, the disadvantage of using those compounds is their inadequate solubility in water.

Thus, an object of the present invention is to provide substantially phosphorus- and zinc-free corrosion inhibitors for aqueous systems which are effective at only low concentrations, are easy to produce and which premanently or completely prevent the corrosion of numerous materials of the type used in plant construction. The compounds used should be harmless in their behavior with respect to the environment and should satisfy the legal requirements imposed in that connection, particularly in regard to their toxicity.

DESCRIPTION OF THE INVENTION

Other than in the operating examples, or where otherwise indicated, all numbers expressing quantities of ingredients or reaction conditions used herein are to be understood as modified in all instances by the term "about".

It has now surprisingly been found that particular dicarboxylic acid mono-(2-hydroxydodecyl)-esters and salts thereof, namely the corresponding monoesters of succinic acid, glutaric acid, itaconic acid and phthalic acid, are capable of effectively inhibiting the corrosion of metals in aqueous systems, especially in raw-water systems, without falling short of ecological requirements.

Accordingly, the present invention relates to dicarboxylic acid mono-(2-hydroxydodecyl)-esters corresponding to the formula

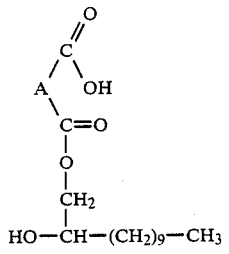

(I)

and to salts thereof corresponding to the following general formula

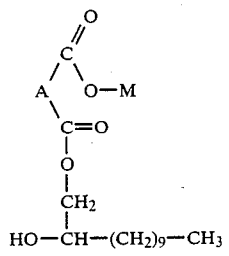

(II)

wherein A represents the radicals

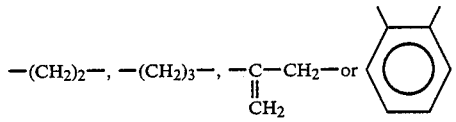

and M represents an alkali metal or ammonium.

Accordingly, general formulae (I) and (II) as defined above encompass the following compounds: succinic acid mono-(2-hydroxydodecyl)-ester, glutaric acid mono-(2-hydroxydodecyl)-ester, itaconic acid mono-(2-hydroxydodecyl)-ester, phthalic acid mono-(2-hydroxydodecyl)-ester, and salts thereof, preferably the sodium, potassium or ammonium salts and particularly the sodium salts.

In addition, the invention relates to the use of dicarboxylic acid mono-(2-hydroxydodecyl)-esters (I) and/or salts thereof (II) in concentrations of from 1 to 100 ppm as corrosion inhibitors in aqueous systems, optionally in the presence of other scale inhibitors and/or dispersants and/or non-ferrous metal inhibitors and/or microbicides known per se.

The invention also relates to the use of dicarboxylic acid mono-(2-hydroxydodecyl)-esters (I) and/or water-soluble salts (II) thereof in combination with one or more complexing agents selected from the group consisting of ethylenediamine tetraacetic acid, nitrilotriacetic acid, citric acid, phosphoric acid esters of ethoxylated sugars and also phosphonic acid and water-soluble salts of these acids, particularly the sodium salts, optionally in the presence of other scale inhibitors and/or dispersants and/or non-ferrous metal inhibitors and/or microbicides known per se as corrosion inhibitors in aqueous systems, the concentration of the mixture of (I) and/or (II) and the complexing agents in aqueous solution being in the range from 1 to 100 ppm and the weight ratio of (I) and/or (II) to the complexing agents being in the range of from 5:1 to 1:5.

The high effectiveness of the compounds herein as corrosion inhibitors is the more surprising since dicarboxylic acid mono-(2-hydroxyalkyl)-esters, in which the ester alkyl groups contain fewer than 12 or more than 12 carbon atoms, and dicarboxylic acid monoalkyl esters which do not contain a hydroxyl group in the ester alkyl group show little, if any, corrosion-inhibiting effect in raw-water circulation systems.

The corrosion inhibitors according to this invention comprise dicarboxylic acid mono-(2-hydroxydodecyl)-esters corresponding to the following formula

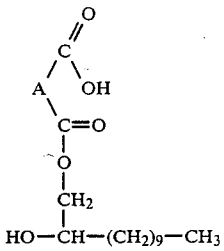

(I)

and water-soluble salts thereof corresponding to the following general formula

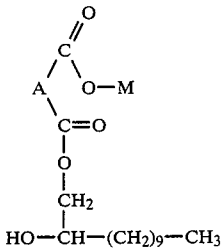

(II)

In general formulae (I) and (II), A represents the radicals

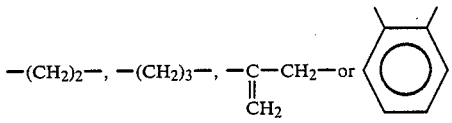

and M represents an alkali metal or ammonium, preferably sodium, potassium or ammonium. The resulting salts (II) all show good solubility in water. Preferred salts of formula (II) are the sodium salts (M=Na).

Accordingly, the corrosion inhibitors used in accordance with this invention include the following compounds: succinic acid mono-(2-hydroxydodecyl)-ester, glutaric acid mono-(2-hydroxydodecyl)-ester, itaconic acid mono-(2-hydroxydodecyl)-ester, phthalic acid mono-(2-hydroxydodecyl)-esters and salts thereof as defined above. Of these, the corresponding monoesters of itaconic acid and glutaric acid and salts thereof are preferred for the use according to the invention.

The compounds (I) according to the invention may readily be obtained in high yields, for example by reacting (a) either the corresponding dicarboxylic acids, i.e. succinic acid, glutaric acid, itaconic acid or phthalic acid, with 1,2-epoxydodecane, or (b) the anhydrides of these dicarboxylic acids with 1,2-dodecane diol, in a molar ratio of the reactants of 1:1 in accordance with the following reaction scheme:

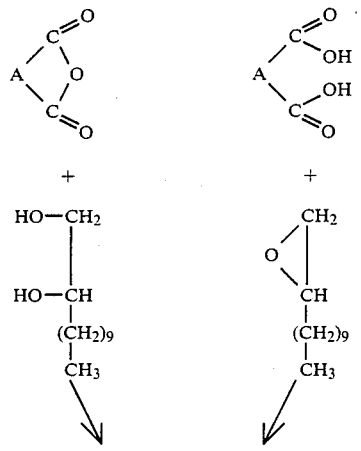

-continued

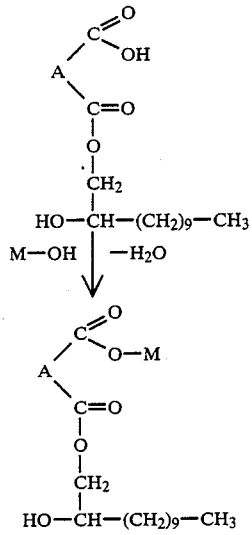

The semi-esters (I) formed by esterification between the acid anhydride or the dicarboxylic acid and the alcohol component may then be neutralized by reaction with an alkali metal or ammonium hydroxide, salts (II) being formed in accordance with the above reaction scheme.

According to the invention, the dicarboxylic acid mono-(2-hydroxydodecyl)-esters (I) and their salts (II), in which A and M are as defined above, are used either individually or in admixture with one another as corrosion inhibitors. The high corrosion-inhibiting effect of the esters (I) by themselves without any other addition is remarkable and of particular advantage for the use according to the invention. For use in accordance with the invention as corrosion inhibitors in aqueous systems, the concentration of the dicarboxylic acid mono-(2-hydroxydodecyl)-esters (I) and/or their salts (II) is in the range of from 1 to 100 g/m$^3$, i.e. in the range of from 1 to 100 ppm. A preferred concentration range is from 10 to 50 ppm of the above-mentioned compounds (I) and/or (II).

Where the compounds (I) and/or (II) are used as corrosion inhibitors for metals, the systems involved are substantially aqueous systems of the type encountered in a water-carrying plant, such as steam-generating plants, heating systems, cooling water circuits and waterline systems. The compounds mentioned may be used with advantage in raw water systems.

In practice, the corrosive behavior of raw water is influenced to a large extent by whether deposit-forming clouding agents are present therein or can be formed by corrosion from the water-carrying parts of the plant. Agents such as these are formed for example through precipitation by water hardness (calcium carbonate), or through precipitation by clays and iron hydroxides. Another object of using dicarboxylic acid mono-(2-hydroxydodecyl)-esters and/or salts thereof in accordance with this invention is also to prevent the formation of deposits from substances such as these and hence to improve the behavior of the raw water in the sense of a further inhibition of corrosion. Accordingly, it is generally of advantage to add to the circulating water not only dicarboxylic acid mono-(2-hydroxydodecyl)-esters (I) and/or salts thereof (II), but also a scale inhibitor and/or dispersant and/or non-ferrous metal inhibitor and/or microbicide known per se for this purpose. The addition of agents such as these is not absolutely essential to the inhibition of corrosion per se, but may further improve the behavior of the raw water in the circulation system.

Accordingly, polyacrylates and/or copolymers of acrylic acid and/or methacrylic acid and/or derivatives thereof having an average molecular weight of from 500 to 4000 and/or ethylene oxide-propylene oxide block copolymers having an average molecular weight of from 500 to 3000 and an ethylene oxide-to-propylene oxide ratio of from 10:90 to 30:70 have proven to be particularly suitable scale inhibitors and/or dispersants. Scale inhibitors and dispersants such as these are used in combination with dicarboxylic acid mono-(2-hydroxydodecyl)-esters (I) and/or salts thereof (II) in quantities of from 1 to 50 g/m$^3$ (1 to 50 ppm) and preferably in quantities of from 3 to 10 ppm.

Depending on the field of application in which the corrosion inhibitors (I) and/or (II) are used in accordance with the invention, it may be of further advantage to use inhibitors for nonferrous metals as further additives known per se for this purpose. Where dicarboxyic acid mono-(2-hydroxydodecyl)-esters and/or water-soluble salts thereof are used in accordance with the invention, 3-heptyl-5-amino-1,2,4-triazole, benzimidazole, benzotriazole and/or tolyl triazole are preferably dissolved in the raw water as non-ferrous metal inhibitors. The non-ferrous metal inhibitors are present in concentrations of from 0.1 to 5 g/m$^3$ (0.1 to 5 ppm).

It may also be of advantage to add microbicides or biocides in quantities of from 1 to 100 g/m$^3$ (1 to 100 ppm) to the raw waters in addition to the components mentioned above. In this case, particularly suitable microbicides or biocides, the use of which is known from the prior art, include glutaraldehyde, glyoxal or alkyl oligoamides, preferably in the form of a reaction product of dodecyl propylenediamine and $\epsilon$-caprolactam in a molar ratio of 1:2.

The dicarboxylic acid mono-(2-hydroxydodecyl)-esters (I) or their water-soluble salts (II) used in accordance with this invention as corrosion inhibitors for metals have the advantage over comparable compounds used as corrosion inhibitors or even, in regard to chemical structure, over completely different corrosion inhibitors, in that they are easy to produce on an industrial scale, for example by the method described above, and develop a remarkably high corrosion-inhibiting effect at only low concentrations in the aqueous systems used. This effect is mainly independent of the pH-value of the aqueous system. In addition, they have no adverse, particularly toxic, effects and may therefore be safely used even in waters which are ultimately run off from the above-mentioned systems into the environment. Further, by comparison with phosphorus-containing corrosion inhibitors, they do not lead to the eutrophication of waters. Still further, where the corrosion inhibitors according to the invention are used, there is no need to use any zinc salts which pollute the effluent because of their toxicity to fish. Further still, there are none of the deposits of zinc hydroxide which normally occur where zinc salts are used in raw-water systems. Another important advantage is the fact that they may readily be used with other additives known per se, such as scale inhibitors and dispersants, non-ferrous metal inhibitors or biocides, and in conjunction with such additives show further improved corrosion-inhibiting behavior.

Accordingly, where ecological aspects, i.e. the complete freedom of zinc and phosphorus from the aqueous cooling water or raw water systems, are important factors, the sole use of the esters corresponding to formula (I) and/or their salts corresponding to general formula (II), preferably the sodium salts, corresponds to a particularly preferred and advantageous embodiment of the present invention which, in addition, is distinctly better in regard to corrosion-inhibiting effectiveness than conventional complexing agents. It has surprisingly been found in accordance with this invention that the combination of complexing agents used for corrosion inhibitors with the esters (I) according to the invention and/or their salts (II) leads to a distinct improvement in corrosion inhibition. This is of advantage particularly when a small phosphorus content arises such as, for example, from the presence of phosphonic acids as complexing agents can be tolerated, for example in closed cooling systems. Accordingly, another preferred embodiment of the invention is characterized in that dicarboxylic acid mono-(2-hydroxydodecyl)-esters (I) and/or water-soluble salts (II), of which the sodium salt is particularly preferred to the other alkali metal salts and to the ammonium salt, may be used either individually or even in admixture with one another.

Complexing agents selected from the group consisting of ethylenediamine tetraacetic acid, nitrilotriacetic acid, citric acid, phosphoric acid esters of ethoxylated sugars and also phosphonic acid and water-soluble salts of these acids, particularly the sodium salts, are suitable for preferred combinations such as these. Of the phosphoric acid esters of ethoxylated sugars, esters of sugars having a degree of ethoxylation of from 1 to 10 and preferably of from 1 to 5 are suitable. The sugars are selected from the group consisting of sorbitol, mannitol, glucose and mixtures of 2 or 3 of these sugars in any quantitative ratio.

The phosphonic acids used may be any of the phosphonic acids suitable for the purposes of complexing, phosphonic acids selected from the group consisting of 1-hydroxyethane-1,1-diphosphonic acid, amino-tris-(methylenephosphonic acid) and 2-phosphonobutane-1,2,4-tricarboxylic acid and also the water-soluble salts of such phosphonic acids being particularly suitable. They may be used herein either individually or in admixture with one another.

The concentration of the combination of dicarboxylic acid mono-(2-dihydroxydodecyl)-ester (I) or water-soluble salts thereof (II) on the one hand, and one or more complexing agents from the above-mentioned group on the other hand in the aqueous solution is in the range of from 1 to 100 ppm and preferably in the range of from 2 to 60 ppm. According to the invention, the ratio of the component ester (I) and/or salt thereof (II) to complexing agent is in the range of from 5:1 to 1:5, the range from 2:1 to 1:2 being particularly preferred.

Although a small phosphorus content in the corrosion inhibiting combinations has to be expected (in the case of the phosphoric acid esters of ethoxylated sugars or the phosphonic acids), it is nevertheless clear that the combination of one or more compounds (I) and/or (II) with one of the above-mentioned complexing agents produces a further significant improvement in the corrosion inhibition values. In cases where combinations such as these are used, the corrosion-inhibiting effect is again substantially independent of the pH value because the acid form of the esters, i.e. the compound (I), is directly formed in the acidic pH range, for example at a pH value of 6.5, while the alkali metal or ammonium salts of the esters, i.e. the compounds (II), are present at alkaline pH values, for example at a pH value of 8.2. Other additives typically used in systems of the type herein may also readily be added with advantage to the combinations according to the invention of compounds (I) and/or (II) with one or more of the above-mentioned complexing agents, with the result that the inhibition of corrosion may be further improved in conjunction with such additives. Additives of the type in question, include, for example, scale inhibitors and/or dispersants, non-ferrous metal inhibitors or biocides from the above-mentioned groups.

The invention is illustrated by the following examples.

EXAMPLE I

In this example the corrosion-inhibiting behavior of compounds (I) and (II) was determined.

Three carefully pretreated, i.e. degreased, pickled and dried, test plates (material: steel strip St 1203 (DIN 1623); dimensions: 75 mm×10 mm×1 mm) were immersed for 6 hours at room temperature in a 1 liter glass beaker filled with 800 ml of test water in which a certain quantity of the dicarboxylic acid mono-(2-hydroxydodecyl)-ester (I) or its sodium salt has been dissolved (cf. Table 1). The aqueous solution was stirred at 100 r.p.m. during the test.

On completion of the test, the plates were cleaned to remove corrosion products and the weight loss was gravimetrically determined. The corrosion inhibition value of the inhibitor according to this invention, based on a blank value, was determined from the mean value of three tests in accordance with the following formula:

$$I\,(\%) = 100 \cdot (1 - a/b)$$

I = corrosion inhibition value, a = weight loss of the plate treated with inhibitor, and b = weight loss of the plate treated without inhibitor.

The blank value was determined on plates of the same quality after treatment with an aqueous solution which did not contain an inhibitor according to the invention.

The test water used as the corrosive medium had the following analysis:

8° Gh. (calcium hardness)

2° Gh. (magnesium hardness)

1° Gh. (carbonate hardness)

500 ppm $Cl^-$.

Table 1 below shows the results of the corrosion inhibition tests using dicarboxylic acid mono-(2-hydroxydodecyl)-esters (DHDE) or sodium salts thereof.

TABLE 1

| | Dosage in ppm | Corrosion inhibition value (I) in % pH 6.5 (acid form) | pH 8.2 (Na salt) |
|---|---|---|---|
| $HOOCCH_2CH_2COOCH_2\underset{\underset{OH}{\vert}}{C}H(CH_2)_9CH_3$ (SHDE[1]) | 30 | 95 | |
| SHDE—Na—salt | 30 | | 94 |
| $HOOCCH_2CH_2CH_2COOCH_2\underset{\underset{OH}{\vert}}{C}H(CH_2)_9CH_3$ (GHDE[2]) | 30 | 94 | |
| GHDE—Na—salt | 30 | | 93 |
| $HOOC\underset{\underset{CH_2}{\Vert}}{C}CH_2COOCH_2\underset{\underset{OH}{\vert}}{C}H(CH_2)_9CH_3$ (IHDE[3]) | 30 | 91 | |
| IHDE—Na—salt | 30 | | 92 |
| 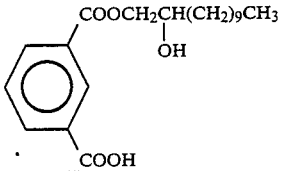 (PHDE[4]) | 30 | 73 | |
| PHDE—Na—salt | 30 | | 85 |

[1]Succinic acid mono-(2-hydroxydodecyl)-ester
[2]Glutaric acid mono-(2-hydroxydodecyl)-ester
[3]Itaconic acid mono-(2-hydroxydodecyl)-ester
[4]Phthalic acid mono-(2-hydroxydodecyl)-ester

COMPARISON EXAMPLE I

Other corrosion inhibitors known per se and compounds structurally, similar to the DHDEs were tested as in Example 1 by comparision with DHDE and the Na salts of DHDE. The results are set out in Table 2 below

TABLE 2

| | | Dosage in ppm | Corrosion inhibition value (I) in % pH 6.5 (acid form) | pH 8.2 (Na salt) |
|---|---|---|---|---|
| (a) | $HOOC(CH_2)_2COOCH_2\underset{\underset{OH}{\vert}}{C}H(CH_2)_7CH_3$ | 30 | 20 | 17 |
| (b) | $HOOC(CH_2)_3COOCH_2\underset{\underset{OH}{\vert}}{C}H(CH_2)_7CH_3$ | 30 | 7 | 12 |
| (c) | $HOOC\underset{\underset{CH_2}{\Vert}}{C}CH_2COOCH_2\underset{\underset{OH}{\vert}}{C}H(CH_2)_7CH_3$ | 30 | 2 | 4 |
| (d) | 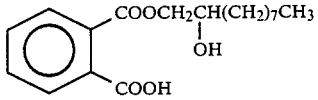 | 30 | 38 | 36 |
| (e) | $HOOCCH{=}CHCOOCH_2\underset{\underset{OH}{\vert}}{C}H(CH_2)_7CH_3$ | 30 | 50 | 14 |
| (f) | $HOOC(CH_2)_2COOCH_2\underset{\underset{OH}{\vert}}{C}H(CH_2)_{11}CH_3$ | 30 | 73 | 30 |
| (g) | $HOOC(CH_2)_2COOCH_2(CH_2)_{10}CH_3$ | 30 | 8 | 12 |
| (h) | HEDP[1] | 30 | 74 | 66 |
| (i) | ATMP[2] | 30 | 76 | 77 |
| (j) | HEDP + $Zn^{++}$ | 30 + 30 | 98 | 90[3] |

TABLE 2-continued

| | Dosage in ppm | Corrosion inhibition value (I) in % pH 6.5 (acid form) | pH 8.2 (Na salt) |
|---|---|---|---|
| (k) ATMP + $Zn^{++}$ | 30 + 30 | 99 | 99(3) |

(1)1-hydroxyethane-1,1-diphosphonic acid
(2)Aminotris-(methylenephosphonic acid)
(3)Zinc hydroxide precipitates Result:

Comparison of the values in Tables 1 and 2 shows that distinctly better corrosion inhibition can be obtained with dicarboxylic acid mono-(2-hydroxydodecyl)-esters (I) or Na-salts thereof than with the compounds structurally similar to the DHDEs (see tests a to g) both in mildly acidic and in mildly basic medium. Comparison compounds a) to f) are corresponding dicarboxylic acid monoesters containing relatively short or relatively long carbon chains in the ester alkyl groups. In the case of the comparison compound g), the ester alkyl group, having a chain length of 12 carbon atoms, does not contain a hydroxyl group. Better or comparable values are obtained by comparison with the corrosion inhibitors known from the prior art (see tests h to k), although, where the DHDEs are used, no phosphorus or zinc enters the waste water, nor are any deposits formed.

EXAMPLE II

This example illustrates the corrosion-inhibiting behavior of a combination of ester (I) or its sodium salt (II) with a complexing agent.

Following the procedure described in Example I, a corresponding number of test plates was treated in an aqueous solution containing a combination of DHDE (I) or a sodium salt thereof (II) and a complexing agent as identified in Table 3. The plates were treated as described in Example I and the corrosion inhibition value of the combination used in accordance with the invention, based on a blank value, was determined in accordance with the formula shown in Example I.

The results are shown in Table 3 below.

COMPARISON EXAMPLE II

Other corrosion inhibitors known per se were tested, in some cases together with zinc salts, for their corrosion-inhibiting behavior in the same way as in Example II by comparison with a combination of DHDE or sodium salts thereof and complexing agents. The results are shown in Table 4 below.

TABLE 3

| Combination | Dosage in ppm | Corrosion inhibition value (I) in % pH 6.5 (acid form) | pH 8.2 (Na salt) |
|---|---|---|---|
| SHDE + ATMP | 10 + 10 | 94 | 95 |
| SHDE + HEDP | 10 + 10 | 94 | 84 |
| SHDE + PBTC(1) | 10 + 10 | 91 | 96 |
| SHDE + EDTA(2) | 10 + 10 | 62 | 65 |
| SHDE + NTA(3) | 10 + 10 | 64 | 69 |
| SHDE + citric acid | 10 + 10 | 89 | 75 |
| SHDE + sorbitol · 2EO · $H_3PO_4$ | 10 + 10 | 97 | 85 |
| GHDE + ATMP | 10 + 10 | 86 | 84 |
| GHDE + HEDP | 10 + 10 | 93 | 74 |
| GHDE + PBTC | 10 + 10 | 93 | 90 |
| GHDE + citric acid | 10 + 10 | 77 | 74 |
| IHDE + ATMP | 10 + 10 | 72 | 89 |
| IHDE + PBTC | 10 + 10 | 78 | 67 |

TABLE 3-continued

| Combination | Dosage in ppm | Corrosion inhibition value (I) in % pH 6.5 (acid form) | pH 8.2 (Na salt) |
|---|---|---|---|
| IHDE + citric acid | 10 + 10 | 90 | 78 |
| PHDE + ATMP | 10 + 10 | 99 | 73 |
| PHDE + citric acid | 10 + 10 | 80 | 76 |

(1)2-phosphonobutane-1,2,4-tricarboxylic acid
(2)Ethylenediamine tetraacetic acid
(3)Nitrilotriacetic acid

TABLE 4

| | Dosage in ppm | Corrosion inhibition value (I) in % pH 6.5 (acid form) | pH 8.2 (Na salt) |
|---|---|---|---|
| ATMP | 10 | 43 | 44 |
| HEDP | 10 | 55 | 35 |
| PBTC | 10 | 61 | 50 |
| EDTA | 10 | 7 | 8 |
| NTA | 10 | 18 | 13 |
| Citric acid | 10 | 31 | 55 |
| Sorbitol · 2 EO · $H_3PO_4$ | 10 | 61 | 44 |
| ATMP + $ZnCl_2$ | 10 + 10 | 99 | 97(1) |
| HEDP + $ZnCl_2$ | 10 + 10 | 98 | 85(1) |
| PBTC + $ZnCl_2$ | 10 + 10 | 97 | 72(1) |

(1)Zinc hydroxide precipitates

Result:

Comparison of the values in Table 3 and 4 shows that, for the same in-use concentrations, the corrosion inhibition values for the combination of DHDE (I) (at pH 6.5) or sodium salts thereof (at pH 8.2) and complexing agents are distinctly higher than the values for the complexing agents alone and are comparable with the values obtained with complexing agents in combination with zinc salt. However, the latter combination has the disadvantage encountered in every case that zinc salts are present in the solution and, in addition, deposits of zinc hydroxide are formed, leading to siltation of the plant system to be protected.

EXAMPLE III

This example illustrates the general preparation of the dicarboxylic acid monoesters.

1 mole of 1,2-dodecanediol and 1 mole of the corresponding anhydride are refluxed for 6 hours in 500 ml of toluene. After cooling, the corresponding precipitated product is filtered off under suction.

(a) Succinic acid mono-(2-hydroxydodecyl)-ester acid number: 177, melting point: 91° C.
(b) Glutaric acid mono-(2-hydroxydodecyl)-ester acid number: 182, melting point: 78° C.
(c) Itaconic acid mono-(2-hydroxydodecyl)-ester acid number: 178, melting point: 104° C.
(d) Phthalic acid mono-(2-hydroxydodecyl)-ester acid number: 148, melting point: 97° C.

We claim:

1. A dicarboxylic acid mono-(2-hydroxydodecyl)-ester corresponding to the following formula

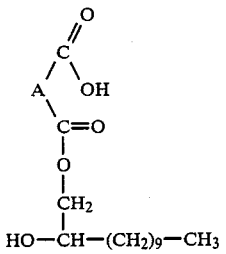

(I)

and a salt thereof corresponding to the following formula

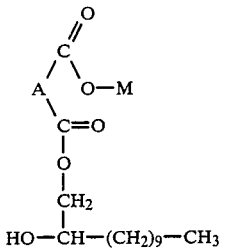

wherein A represents the radicals

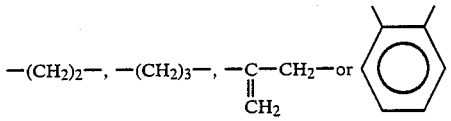

and M represents an alkali metal or ammonium.

2. A compound as in claim 1 wherein said ester is selected from the group consisting of succinic acid mono-(2-hydroxydodecyl)-ester, glutaric acid mono-(2-hydroxydodecyl)-ester, itaconic mono-(2-hydroxydodecyl)-ester, phthalic acid mono-(2-hydroxydodecyl)-ester, and salts thereof.

3. A compound as in claim 1 wherein M represents sodium, potassium or ammonium.

4. A composition containing an ester or salt thereof as in claim 1 including a complexing agent selected from the group consisting of ethylenediamine tetraacetic acid, nitrilotriacetic acid, citric acid, phosphoric acid ester of an ethoxylated sugar, phosphonic acid, and a water-soluble salt thereof, said ester or salt thereof and said complexing agent being present in said composition in an amount sufficient so that upon dilution of said composition in water said ester or salt thereof and said complexing agent are present in said water in an amount of from about 1 to about 100 ppm.

5. A composition as in claim 4 including a scale inhibitor and/or a dispersant, a non-ferrous metal inhibitor, and a microbicide, said scale inhibitor and/or dispersant, said non-ferrous metal inhibitor and said microbicide being present in said composition in an amount sufficient so that upon dilution of said composition in water said scale inhibitor and/or dispersant is present in said water in an amount of from about 1 to about 50 ppm, said metal inhibitor is present in said water in an amount of from about 0.1 to about 5 ppm, and said microbicide is present in said water in an amount of from about 1 to about 100 ppm.

6. A composition as in claim 5 wherein said non-ferrous metal inhibitor is selected from the group consisting of 3-heptyl-5-amino-1,2,4-triazole, benzimidazole, benzotriazole, and tolyl triazole.

7. A composition as in claim 5 wherein said microbicide is selected from the group consisting of glutaraldehyde, glyoxal and alkyl oligoamide.

8. A composition as in claim 4 wherein said phosphonic acid is selected from the group consisting of 1-hydroxyethane-1,1-diphosphonic acid, amino-tris-(methylene-phosphonic acid), 2-phosphonobutane-1,2,4-tricarboxylic acid, and water soluble salts thereof.

9. A composition as in claim 5 wherein said scale inhibitor and/or dispersant is selected from the group consisting of a polyacrylate, a copolymer of acrylic acid or methacrylic acid and/or derivatives thereof having an average molecular weight of from about 500 to about 4,000, and an ethylene oxide-propylene oxide block copolymer having an average molecular weight of from about 500 to about 3,000.

10. A method of inhibiting corrosion in an aqueous system comprising adding to said system a corrosion inhibitive amount of a dicarboxylic acid mono-(2-hydroxydodecyl)-ester corresponding to the following formula

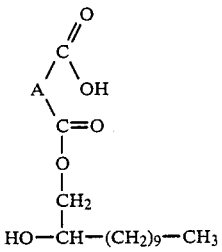

(I)

and a salt thereof corresponding to the following formula

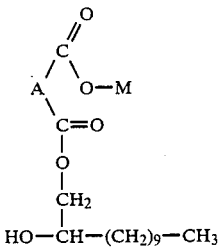

(II)

wherein A represents the radicals

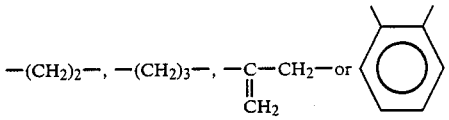

and M represents an alkali metal or ammonium.

11. A method as in claim 10 wherein said ester is selected from the group consisting of succinic acid mono-(2-hydroxydodecyl)-ester, glutaric acid mono-(2-hydroxydodecyl)-ester, itaconic mono-(2-hydroxydodecyl)-ester, phthalic acid mono-(2-hydroxydodecyl)-ester, and salts thereof.

12. A method as in claim 10 wherein M represents sodium, potassium or ammonium.

13. A method as in claim 10 wherein said ester is present in said aqueous system in an amount of from about 1 to about 100 ppm.

14. A method as in claim 10 wherein said salt is present in said aqueous system in an amount of from about 1 to about 100 ppm.

15. A method as in claim 10 including adding to said aqueous system a complexing agent selected from the group consisting of ethylenediamine tetraacetic acid, nitrilotriacetic acid, citric acid, phosphoric acid ester of an ethoxylated sugar, phosphonic acid, and a water-soluble salt thereof.

16. A method as in claim 10 including adding to said aqueous system a scale inhibitor and/or a dispersant, a non-ferrous metal inhibitor and a microbicide.

17. A method as in claim 16 wherein said non-ferrous metal inhibitor is selected from the group consisting of 3-heptyl-5-amino-1,2,4-triazole, benzimidazole, benzotriazole, and tolyl triazole.

18. A method as in claim 16 wherein said microbicide is selected from the group consisting of glutaraldehyde, glyoxal and alkyl oligoamide.

19. A method as in claim 15 wherein said phosphonic acid is selected from the group consisting of 1-hydroxyethane-1,1-disphosphonic acid, amino-tris-(methylenephosphonic acid), 2-phosphonobutane-1,2,4-tricarboxylic acid, and water-soluble salts thereof.

20. A method as in claim 15 wherein said phosphoric acid ester of an ethoxylated sugar has a degree of ethoxylation of from about 1 to about 10, and said sugar is selected from the group consisting of sorbitol, mannitol and glucose.

21. A method as in claim 16 wherein said scale inhibitor and/or dispersant is selected from the group consisting of a polyacrylate, a copolymer of acrylic acid or methacrylic acid and/or derivatives thereof having an average molecular weight of from about 500 to about 4,000, and an ethylene oxide-propylene oxide block copolymer having an average molecular weight of from about 500 to about 3,000.

22. A method as in claim 10 wherein said ester and/or said salt is present in said aqueous system in an amount of from about 10 to about 50 ppm.

23. A method as in claim 15 wherein the concentration of said mixture of said ester and/or said salt thereof and said complexing agent is in the range of from about 1 to about 100 ppm and the ratio of said ester and/or said salt thereof to said complexing agent is in the range of from 5:1 to 1:5.

24. A method as in claim 23 wherein the the concentration of said mixture of said ester and/or said salt thereof and said complexing agent is in the range of from about 2 to about 60 ppm.

25. A method as in claim 23 wherein the ratio of said ester and/or said salt thereof to said complexing agent is in the range of from 2:1 to 1:2.

26. A method as in claim 16 wherein said scale inhibitor and/or dispersant is present in a quantity of from about 1 to about 50 ppm, said metal inhibitor is present in a quantity of from about 0.1 to about 5 ppm, and said microbicide is present in a quantity of from about 1 to about 100 ppm.

27. A method as in claim 26 wherein said scale inhibitor and/or dispersant is present in a quantity of from about 3 to about 10 ppm.

* * * * *